US005486820A

United States Patent [19]

Chatigny et al.

[11] Patent Number: 5,486,820

[45] Date of Patent: Jan. 23, 1996

[54] TRAFFIC SENSOR HAVING PIEZOELECTRIC SENSORS WHICH DISTINGUISH LANES

[75] Inventors: Joseph V. Chatigny, Wayne; Mitchell Thompson, Exton; Peter F. Radice, King of Prussia; Donald L. Halvorsen, Phoenixville, all of Pa.

[73] Assignee: The Whitaker Corporation, Wilmington, Del.

[21] Appl. No.: 992,577

[22] Filed: Dec. 18, 1992

[51] Int. Cl.[6] ..... G08G 1/01

[52] U.S. Cl. ..... 340/933; 340/934; 340/940; 340/666; 73/146

[58] Field of Search ..... 340/933, 934, 340/936, 939, 940, 941, 566, 665, 666; 174/115, 117 F, 110 A, 118, 36, 105 SC, 106 SC; 73/146; 177/132, 211; D10/97; 377/9; 116/63 R; 404/22

[56] References Cited

U.S. PATENT DOCUMENTS

| | | | |
|---|---|---|---|
| 3,631,387 | 12/1971 | Hill | 340/923 |
| 3,750,127 | 7/1973 | Ayers et al. | 340/261 |
| 3,753,223 | 8/1973 | Fayling | 340/905 |
| 3,798,474 | 3/1974 | Cassand et al. | 310/9.6 |
| 3,911,390 | 10/1975 | Myers | 340/38 R |
| 4,194,194 | 3/1980 | Redfern | 340/665 |
| 4,303,733 | 12/1981 | Bulle et al. | 428/367 |
| 4,383,239 | 5/1983 | Robert | 340/38 R |
| 4,604,958 | 9/1971 | Oscar | 340/665 |
| 4,609,845 | 9/1986 | Soni et al. | 310/357 |
| 4,712,423 | 12/1987 | Siffert et al. | 73/146 |
| 4,762,970 | 8/1988 | Brinsley | 340/666 |
| 4,888,581 | 12/1989 | Guscott | 340/666 |
| 4,939,512 | 7/1990 | Dennison et al. | 340/933 |
| 5,008,666 | 4/1991 | Gebert et al. | 340/936 |
| 5,206,642 | 4/1993 | Gregoire et al. | 340/933 |
| 5,239,148 | 8/1993 | Reed | 340/933 |
| 5,245,334 | 9/1993 | Gebert et al. | 340/933 |
| 5,265,481 | 11/1993 | Sonderegger et al. | 340/666 |

FOREIGN PATENT DOCUMENTS

| | | |
|---|---|---|
| 0186534 | 8/1986 | France . |
| 2625808 | 7/1989 | France . |
| 0534532 | 3/1993 | France . |

*Primary Examiner*—Brent A. Swarthout
*Assistant Examiner*—Nina Tong

[57] ABSTRACT

A traffic sensor including piezoelectric sensors having different polarities in different lanes of the roadway so that traffic data for different lanes of a roadway may be discriminated from the polarity of the received signal(s). Preferably, the piezoelectric sensors are formed by splicing oppositely polarized piezoelectric cables or films, by changing the applied electric field during manufacture so that adjacent portions of a piezoelectric cable or film have different polarities, or by applying an electric field of a reversed polarity to respective longitudinal sections of a piezoelectric film. Traffic data from up to 8 different lanes of traffic may be discriminated using only two piezoelectric sensors in accordance with the invention by providing unique combinations of output polarities for deflections of the piezoelectric sensors in the different lanes. In order to simplify installation, such piezoelectric sensors may be disposed in parallel within the same housing or concentrically within the same cable.

28 Claims, 5 Drawing Sheets

TRAFFIC SENSOR HAVING PIEZOELECTRIC SENSORS WHICH DISTINGUISH LANES

BACKGROUND OF THE INVENTION

1. Field of the Invention

The present invention relates to a traffic sensor having bipolar or multi-polar piezoelectric sensing elements which uniquely identify a lane in which a vehicle is detected, and more particularly, to a piezoelectric cable or film which when stretched across a roadway generates electrical signals of different polarities or of different states in respective lanes of the roadway so that the lane from which one or more electrical signals are received may be readily discriminated by the polarity or state of the received electrical signal(s).

2. Description of the Prior Art

Traffic engineers typically collect data concerning traffic speed and density, vehicle size, loading and type, and vehicle condition as an aid in determining the design parameters for roads, highways, bridges and other structures. However, for multi-lane highways, acquiring the data required for complete evaluation and planning of these structures becomes quite difficult because of the need to monitor many lanes simultaneously. Indeed, the volume and complexity of the data required to make a complete evaluation of multi-lane roadways renders manual traffic counting impractical. As a result, automatic traffic recorders have been developed for recording data in a form which may be readily tabulated and evaluated.

Due to their electromechanical characteristics, piezoelectric materials such as piezoelectric polymer cables and films have been used as traffic sensors for acquiring traffic data. In the standard configuration, one piezoelectric sensor is disposed in each lane of traffic so that discrete electrical signals may be detected from each of the piezoelectric sensors. Unfortunately, while this technique works well for two-lane roadways, it becomes quite burdensome when traffic is to be monitored for more than two lanes of traffic. One major problem with such sensors is that they are difficult to install in the roadway and such installation requires substantial labor and creates major safety concerns. As a result, it is desired that as few easy to install sensors as possible be used to obtain the desired traffic data.

Such a standard traffic sensor is described by Myers in U.S. Pat. No. 3,911,390. Myers obtains traffic information by placing an elongated traffic sensor strip having a plurality of detector segments appropriately spaced along the sensor across a multi-lane roadway to monitor traffic in the lanes of the multi-lane roadway. The detector segments may each include a pair of parallel spaced conducting plates which generate an output signal when pushed together by the weight of a vehicle, or alternatively, the detector segments may each comprise a coaxial cable in place of the parallel spaced conducting plates. Generally, a separate detector segment is placed in each lane so that the lane may be discriminated; however, in an alternative embodiment, two or more coaxial cables are placed across the roadway to provide lane segregation. In the latter embodiment, the first coaxial cable extends completely across two lanes of traffic while the second coaxial cable extends only across one lane. The lane through which a vehicle passes is then discriminated by logically ANDing the positive outputs from each cable which are generated when the coaxial cables are deflected by the wheels of a vehicle. In this manner, the lane is discriminated in accordance with whether a positive pulse is received from just one or both cables.

The traffic sensor described by Myers typically has a low profile so that it is not readily visible by the motorists and has a gradually tapering profile so that it provides a smooth tire transition for a vehicle. The traffic sensor described by Myers is generally designed to be quite durable so that it can resist wear and damage from dirt or moisture. However, the durability of the sensor is improved by anchoring it in the roadway so that it will remain in position over a long period of time. Unfortunately, the sensors of Myers are difficult to install in the roadway, require the roadway to be closed for installation, and do not alleviate the above-mentioned safety concerns.

Traffic sensors have also been used to measure the dynamic loads exerted on a highway by traffic. For example, Siffert et al. describe in U.S. Pat. No. 4,712,423 a process for allegedly measuring the dynamic load exerted on a highway by the axles of vehicles by using the outputs of two piezoelectric cables installed in the roadway which are sensitive to the pressure and speed of vehicles passing thereover. In particular, the electrical pulses generated by the passage of vehicles over the sensors described by Siffert et al. are processed to extract weight information and speed information therefrom which is in turn used to calculate the dynamic load. However, such weigh-in-motion techniques, though relatively simple in theory, have proven difficult to implement in practice. Moreover, Siffert et al. do not disclose how to discriminate such information for different lanes of multi-lane roadways.

Similarly, Gebert et al. describe in U.S. Pat. No. 5,008,666 traffic measurement equipment including a pair of coaxial cables having piezoelectric materials and a vehicle presence detector embedded therein for detecting vehicle count, vehicle length, vehicle time of arrival, vehicle speed, the number of axles per vehicle, axle distance per vehicle, vehicle gap, headway and axle weights, and the like. This is accomplished by extending the coaxial cables including the piezoelectric materials across the roadway, measuring signals induced in the cable by passage of vehicle wheels thereover, and processing the signals to compute a total integrated spectral power of the measured signals so as to establish an empirical relationship between speed and weight of the vehicle wheels passing over the coaxial cables. However, as with Siffert et al., Gebert et al. install a separate detector in each lane and thus provide no means for collecting traffic data from multiple lanes using a minimum number of easy to install detectors.

It is desired to extend the traffic measurement techniques described by Myers, Siffert et al. and Gebert et al. to further include means for distinguishing traffic data collected from multiple lanes of a roadway using a minimum number of easy to install detectors. In particular, it is desired to develop a piezoelectric material which can generate pulses of different polarities or states in different longitudinal sections thereof so that, for example, if the piezoelectric material is extended across a multi-lane roadway, pulses of different polarities are generated in different lanes so as to uniquely identify those lanes. It is also desirable that the resulting traffic sensor be easy to install so that it can be placed across multi-lane roadways with minimum disruption of traffic. The present invention has been designed to meet these needs.

SUMMARY OF THE INVENTION

The present inventors have developed a bipolar or multi-polar elongated piezoelectric material which may be used in a traffic sensor to discriminate lanes by generating electrical signals having different polarities in different lanes of a multi-lane roadway. During manufacture of the piezoelectric sensor of the invention, the polarity of the poling field of the piezoelectric material is varied in different longitudinal sections of the piezoelectric material so that the piezoelectric material will generate pulses having different polarities in different longitudinal sections. When stretched across a roadway, the piezoelectric sensor will give, for example, a positive output when run over by a vehicle in one lane and a negative output when run over by a vehicle in another lane. Then, by using only two bipolar piezoelectric sensors in a single traffic sensor in accordance with the techniques of the invention, traffic data from up to eight lanes of traffic may be discriminated using only one simple to install traffic sensor.

In particular, the present invention relates to a piezoelectric sensor having a first polarity for a finite length in a first longitudinal section thereof and a second polarity, different from the first polarity, for a finite length in a second longitudinal section which is adjacent the first longitudinal section in a longitudinal direction of the sensor. When so configured, a deflection of the piezoelectric sensor in one of the longitudinal sections generates an electrical signal having a polarity unique to the deflected longitudinal section.

The piezoelectric sensor of the invention may be configured as a piezoelectric cable or a piezoelectric film formed by a variety of techniques. For example, the piezoelectric sensor may be formed from a first piezoelectric cable or film having the first polarity which is spliced to a second piezoelectric cable or film having the second polarity. The spliced piezoelectric cables also may be enclosed in a braided sheath and an outer jacket for protection from dirt and moisture and the like. The piezoelectric material also may comprise a piezoelectric cable or film which is polarized during manufacture to have the first polarity in the first longitudinal section and then is polarized to have the second polarity in the second longitudinal section. This may be accomplished, for example, by varying the applied electric field as the piezoelectric material is extracted through an extruder. Of course, the piezoelectric material may be polarized into more than two polarities as desired. In addition, the piezoelectric sensor may be formed by twisting the piezoelectric material such that it has different polarization states on either side of the twist. The same effect may also be achieved by placing conducting electrodes on either side of the longitudinal sections of the piezoelectric material and connecting electrodes on opposite sides of the piezoelectric material in different longitudinal sections by way of through holes so that electric fields of different polarities may be applied to adjacent longitudinal sections.

The invention further includes a traffic sensor incorporating such a piezoelectric sensor for sensing the number of vehicles travelling in each lane of a predetermined portion of a roadway. In particular, a traffic sensor in accordance with the invention preferably comprises a piezoelectric sensor stretched across a width of the predetermined portion of the roadway so as to generate an electrical signal when deflected by a vehicle. Preferably, the generated electrical signal has a first polarity when deflected by a vehicle in a first lane of the roadway and a second polarity when deflected by a vehicle in a second lane of the roadway. The polarity of the generated electrical signal is then discriminated by roadside electronics for determining from the polarity of the received electrical signal(s) in which lane of the roadway the piezoelectric sensor has been deflected by a vehicle.

The electronics may comprise, for example, first and second counters corresponding to the first and second lanes of the roadway, where the first counter is incremented when the electrical signal has the first polarity and the second counter is incremented when the electrical signal has the second polarity. The electronics may also include a microprocessor for determining the time of arrival and polarity of a received electrical signal and a memory for storing data indicating the time of arrival along with a designation of the lane from which the electrical signal was generated. The microprocessor may also be responsive to an inductive loop which detects the passage of a vehicle so as to determine how many electrical signals generated in a particular lane correspond to a single vehicle.

Generally, a traffic sensor in accordance with the invention may measure the number of vehicles travelling in each lane L of a predetermined portion of a multi-lane roadway by stretching n piezoelectric sensors in a substantially parallel manner across a width of the predetermined portion of the roadway and generating at each of the n piezoelectric sensors an electrical signal having one of s states when that piezoelectric sensor is deflected by a vehicle in one of the lanes L of the roadway. Up to $L=s^n$ lanes of the multilane roadway may be uniquely identified in this manner. In a preferred embodiment, the n piezoelectric sensors are disposed concentrically with respect to each other in the same cable housing and placed over at least two lanes of the predetermined portion of the roadway. Alternatively, one concentric piezoelectric sensor may be placed across two lanes while the other differently polarized concentric piezoelectric sensor is placed across only one lane in a manner analogous to that described by Myers.

An alternative embodiment of a traffic sensor is also described in which a separate piezoelectric sensor for each lane of the predetermined portion of the roadway is disposed in a rugged housing which is stretched across the predetermined portion of the roadway. A separate cable within the housing is connected to each of the piezoelectric sensors in each lane for relaying the electrical signals generated by the piezoelectric sensors to a measuring location where the lane from which the traffic data is measured is readily determined by the cable from the traffic data is received.

BRIEF DESCRIPTION OF THE DRAWINGS

The objects and advantages of the invention will become more apparent and more readily appreciated to one of ordinary skill in the art from the following detailed description of the presently preferred exemplary embodiments of the invention taken in conjunction with the accompanying drawings, of which.

DETAILED DESCRIPTION OF THE PREFERRED EMBODIMENTS

A bipolar or multi-polar piezoelectric sensor and a traffic sensor using such piezoelectric sensors in accordance with the presently preferred exemplary embodiments of the invention will be described below with reference to FIGS. 1–13. It will be appreciated by those of ordinary skill in the art that the description given herein with respect to those figures is for exemplary purposes only and is not intended in any way to limit the scope of the invention. Accordingly, all questions regarding the scope of the invention may be resolved by referring to the appended claims.

A preferred embodiment of the present invention relates to traffic sensors having piezoelectric sensors for discriminating traffic data from different lanes of a roadway. In a preferred embodiment, this is accomplished by designing elongated piezoelectric sensors which have different polarities in respective longitudinal sections thereof and stretching the piezoelectric sensors across respective lanes of the roadway so that portions of the piezoelectric sensor in different lanes of the roadway generate electrical signals of different polarities when a vehicle passes thereover. By arranging two or more such piezoelectric sensors across multiple lanes of a multi-lane roadway, the respective lanes may be discriminated using simple Boolean logic. In the simplest configuration, a positive pulse is generated by the portion of the piezoelectric sensor in lane 1, while a negative pulse is generated by the portion of the piezoelectric sensor in lane 2. The lanes are then discriminated on the basis of the polarity of the received pulse. As will be described below, this technique of the invention may be expanded so that up to $L=s^n$ lanes can be monitored using n sensors having s states.

Figure 1:
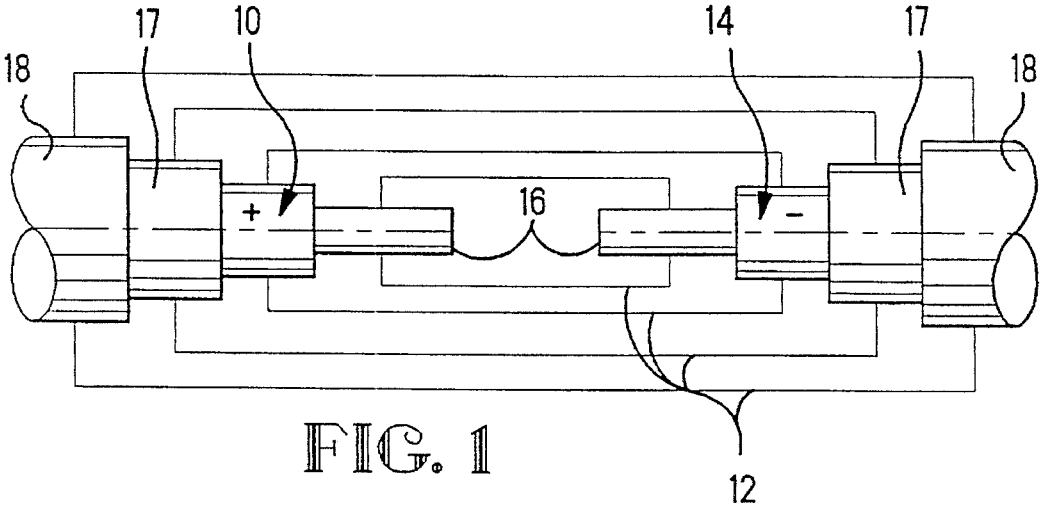
FIG. 1 illustrates a bipolar piezoelectric cable sensor which is formed by splicing a positively polarized piezoelectric cable with a negatively polarized piezoelectric cable.
Figure 2:
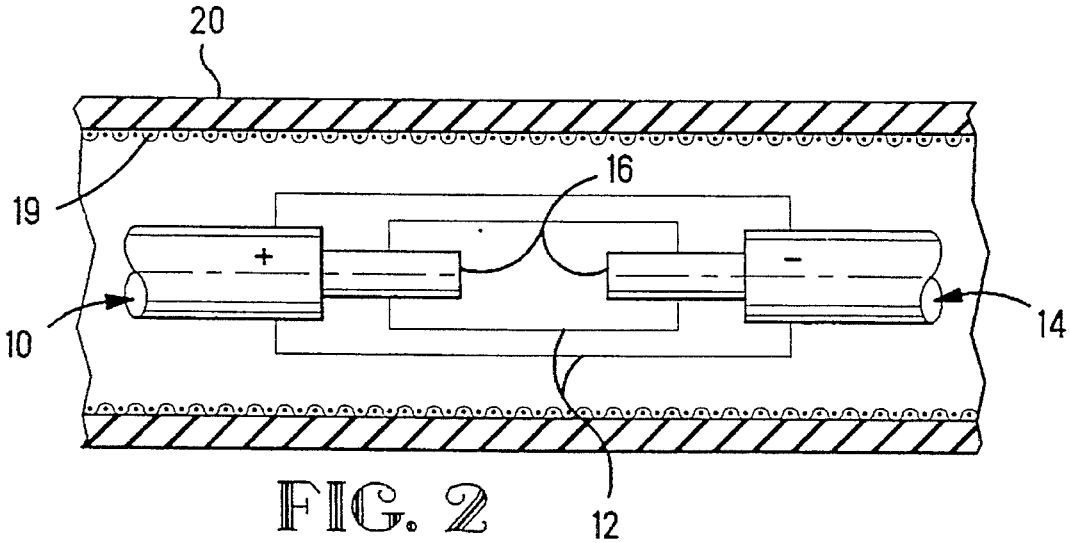
FIG. 2 illustrates a bipolar piezoelectric cable sensor which is formed by splicing a positively polarized piezoelectric cable with a negatively polarized piezoelectric cable and enclosing the spliced cables within a braided sheath and an outer jacket for protection from the elements.
Figure 3:
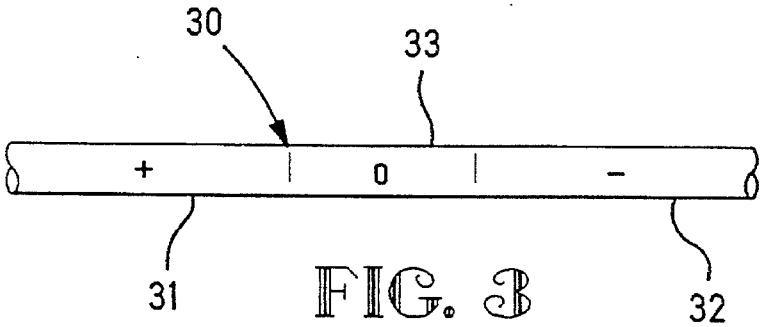
FIG. 3 illustrates a multi-polar piezoelectric cable sensor which has different polarities in different longitudinal sections thereof which are formed during the manufacturing process by applying an electric field having a first polarity during extrusion of a first length of cable and applying an electric field having a second polarity during extrusion of a second length of cable.

A number of different techniques are used in accordance with the invention to develop piezoelectric sensors which have different polarities along the longitudinal length thereof. FIGS. 1–3 illustrate embodiments of piezoelectric sensors formed from piezoelectric cables, while FIGS. 4–7 illustrate embodiments of piezoelectric sensors formed from piezoelectric films.

As illustrated in FIG. 1, a bipolar piezoelectric sensor may be formed by splicing a positively polarized piezoelectric cable 10 using splices 12 to a negatively polarized piezoelectric cable 14. The inner core conductors 16, the electrodes 17 and the dielectric layers 18 are also spliced as indicated so that the lengths of cable on either side of splices 12 generate electrical signals of different polarities upon deflection.

FIG. 2 illustrates an embodiment of a piezoelectric sensor similar to that of FIG. 1 except that the spliced positively polarized piezoelectric cable 10 and negatively polarized piezoelectric cable 14 are wrapped in a braided sheath 19 and an outer jacket 20 for protection from the elements. This arrangement protects the piezoelectric cables from dirt and moisture, thereby extending the useful life of the cables.

FIG. 3 illustrates an embodiment of a multi-polar piezoelectric sensor comprising a piezoelectric cable 30 which has a positively polarized (+) longitudinal region 31 and a negatively polarized (–) longitudinal region 32 separated by a neutral region (0) 33. Such a piezoelectric sensor in accordance with the invention is formed by forming a cable of piezoelectric material such as PVDF and $PVF_2$ using extrusion or some other known manufacturing process. However, in accordance with the invention, the resulting piezoelectric cable is polarized during manufacture by applying a positive electric field to the piezoelectric cable during extrusion for a period of time sufficient to obtain a positively polarized length of cable of the desired length. The positive electric field is then switched over to a negative electric field, and because of the real-time operation of the extrusion process, a neutral region is formed during the transition of the electric field. The negative electric field is then applied to the piezoelectric cable during extrusion for a period of time sufficient to obtain a negatively polarized length of cable of the desired length. This process may be repeated until the desired number of oppositely polarized regions are formed in the piezoelectric cable. In a preferred embodiment of the piezoelectric sensor for use in a traffic sensor, each positively and negatively polarized region approximates the width of a lane of roadway, with the neutral region corresponding to the portion of the roadway between lanes.

Figure 4:
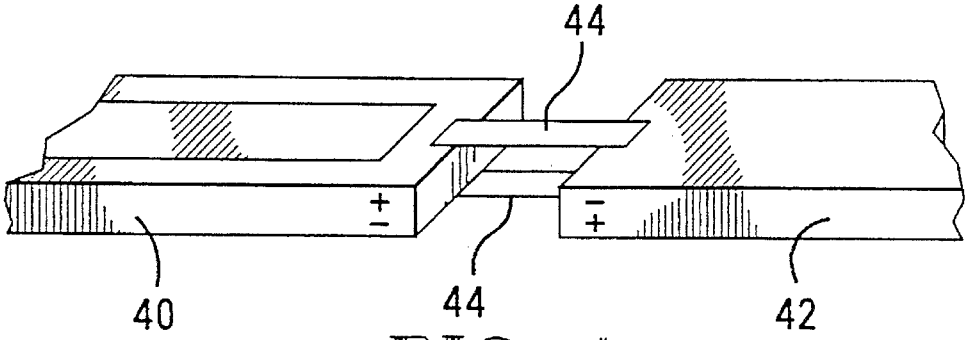
FIG. 4 illustrates a piezoelectric film sensor comprising oppositely polarized piezoelectric films which are spliced together.

FIG. 4 illustrates an embodiment of a piezoelectric sensor comprising separate piezoelectric films 40 and 42 which are spliced using splice 44 so that the respective films have opposite polarities.

Figure 5:
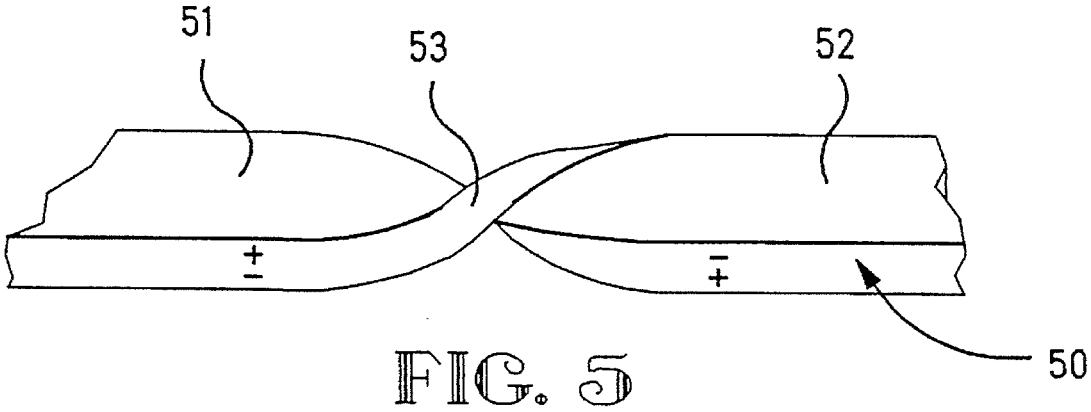
FIG. 5 illustrates a piezoelectric film sensor comprising a single twisted piezoelectric film which has different polarities on either side of the twist.

FIG. 5 illustrates an alternative embodiment of a piezoelectric sensor comprising a single piezoelectric film 50 which is twisted so that the portions 51 and 52 of the piezoelectric film on opposite sides of the twist 53 have opposite polarities.

Figure 6:
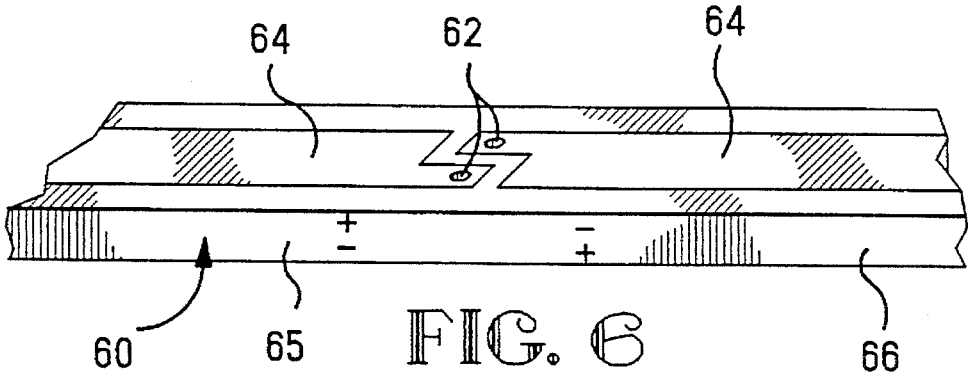
FIG. 6 illustrates a piezoelectric film sensor having opposite electrodes from adjacent longitudinal sections connected via through holes so that electric fields of opposite polarity may be applied to the adjacent longitudinal sections of the piezoelectric film.

FIG. 6 illustrates another embodiment of a piezoelectric sensor comprising a single piezoelectric film 60 having through holes 62 for connecting separate electrodes 64 along adjacent longitudinal sections 65 and 66 of the piezoelectric film 60 in such a manner that the polarities of the applied electric fields are reversed for the adjacent longitudinal sections 65 and 66 of the piezoelectric film 60.

Figure 7:
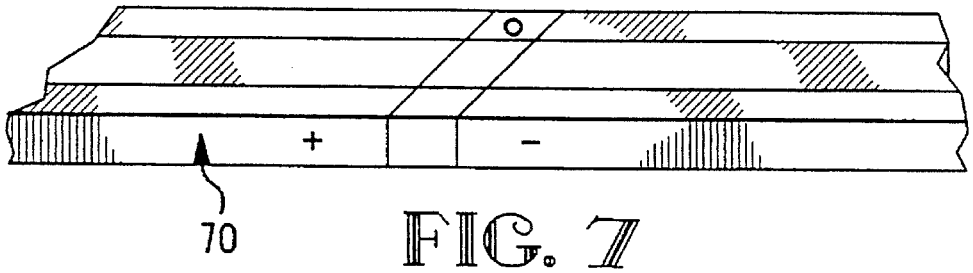
FIG. 7 illustrates a multi-polar piezoelectric film sensor which is polarized during manufacture in the same manner as the piezoelectric cable sensor of FIG. 3.

FIG. 7 illustrates an embodiment of a multi-polar piezoelectric sensor comprising a single piezoelectric film 70 formed in accordance with the technique described above with respect to FIG. 3 except that the piezoelectric cable 30 is replaced by the piezoelectric film 70 in the extrusion process.

Traffic sensors implementing such bipolar and multi-polar piezoelectric sensors will now be described with respect to FIGS. 8–13.

Figure 8:
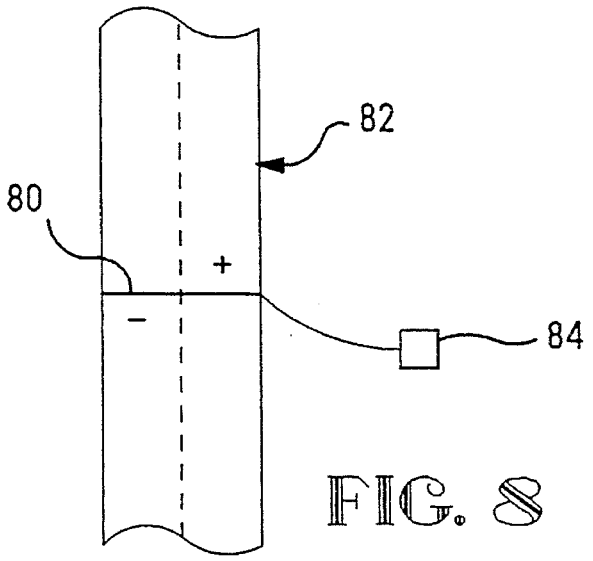
FIG. 8 illustrates an implementation of the piezoelectric sensors of the invention as a traffic sensor which discriminates lanes of a roadway.

Typically, when a piezoelectric material is used in a traffic sensor, the normal convention is for the piezoelectric material to provide a positive output pulse when run over by a vehicle. Similarly, if the polarity of the poling field is reversed during the manufacturing process, the piezoelectric material would provide a negative output pulse when run over by a vehicle. Accordingly, if a piezoelectric sensor of the type described above is manufactured to have reversed polarity for different sections thereof, one sensor may be used for two lanes of traffic as illustrated in FIG. 8. In particular, the piezoelectric sensor 80 is formed such that it has different polarities or states in respective longitudinal sections thereof which have lengths approximating the width of a lane of a roadway. As illustrated in FIG. 8, piezoelectric sensor 80 is preferably placed across a two lane roadway 82 such that a deflection of the piezoelectric sensor 80 in one lane causes generation of a negative pulse, while deflection of the piezoelectric sensor 80 in the other lane causes generation of a positive pulse. Electronics 84 then discriminate the polarity of the received pulse to determine which lane detected passage of a vehicle. Thus, by reversing the polarization during manufacture of the piezoelectric sensor as described above, one sensor may be used to readily discriminate data from two lanes of traffic.

Figure 9:
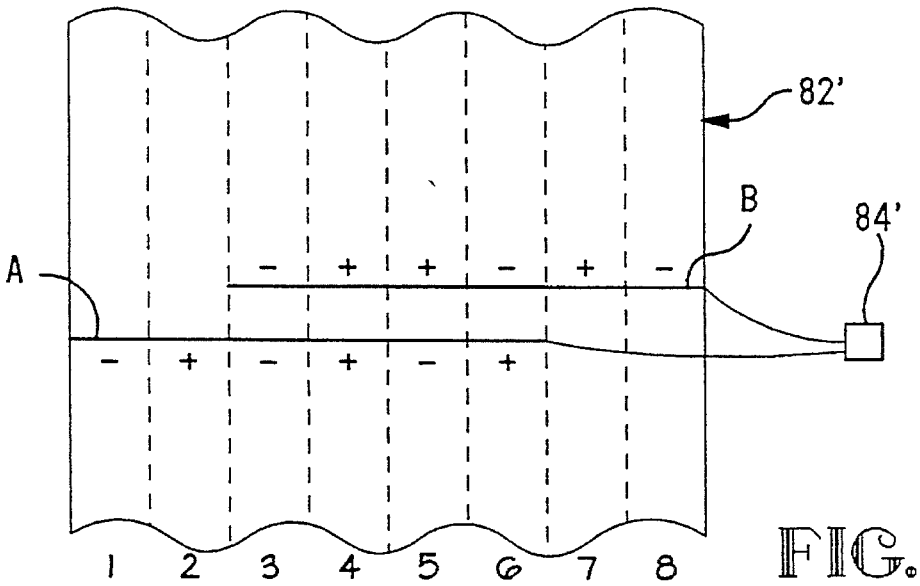
FIG. 9 illustrates an implementation of the piezoelectric sensors of the invention as a traffic sensor whereby two piezoelectric sensors having different polarities in different lanes discriminate 8 different lanes of a multi-lane roadway.

FIG. 9 illustrates an embodiment where two bipolar piezoelectric sensors A and B designed in accordance with the techniques of the invention are employed in parallel with each other to monitor up to eight lanes of traffic in roadway 82'. As shown in FIG. 9, piezoelectric sensor A and piezoelectric sensor B have polarities along their respective longitudinal sections corresponding to each lane so that a unique combination of electrical signals will be received by electronics 84' for discriminating the traffic data from each of the lanes 1 through 8. For example, lane 3 is identified when a negative pulse is received from piezoelectric sensors A and B, while lane 6 is discriminated when a positive pulse is received from sensor A and a negative pulse is received from sensor B. As will be appreciated by those skilled in the art, in the lanes where there is only one sensor (lanes 1, 2, 7 and 8), the traffic sensor would function in a manner quite similar to that described above with respect to FIG. 8. On the other hand, in the middle lanes (lanes 3–6), a lane is identified by the combination of piezoelectric sensor outputs as just described. Preferably, the piezoelectric sensors A and B are mounted very close to each other so that the time difference between an event occurring on piezoelectric sensor A and piezoelectric sensor B will be much less than the time until another pulse from the same piezoelectric sensor is received.

As illustrated in FIG. 9, the piezoelectric sensors A and B may be separate piezoelectric sensors which are placed in parallel with each other across the roadway. However, in order to ease installation of the piezoelectric sensors A and B, they may be disposed in a single homogeneous unit in a number of different configurations. Preferably, the homogeneous unit is quite rugged so as to withstand the wear and tear from vehicle traffic and is also insulated from dirt and water. If the piezoelectric sensors A and B are formed from piezoelectric film, the homogeneous unit may be formed by stacking or wrapping and then laminating different layers of the film together so that the sensors would be parallel to each other in a very intimate manner. On the other hand, if the piezoelectric sensors A and B are formed from piezoelectric cable, the piezoelectric cable could preferably be manufactured so that the piezoelectric sensors are concentric by forming the first piezoelectric cable and then extruding or wrapping a second layer of piezoelectric material having a different polarity on top of the first cable. Polarization would then occur between the outer electrode of the inner cable and a second outer electrode.

Figure 10:
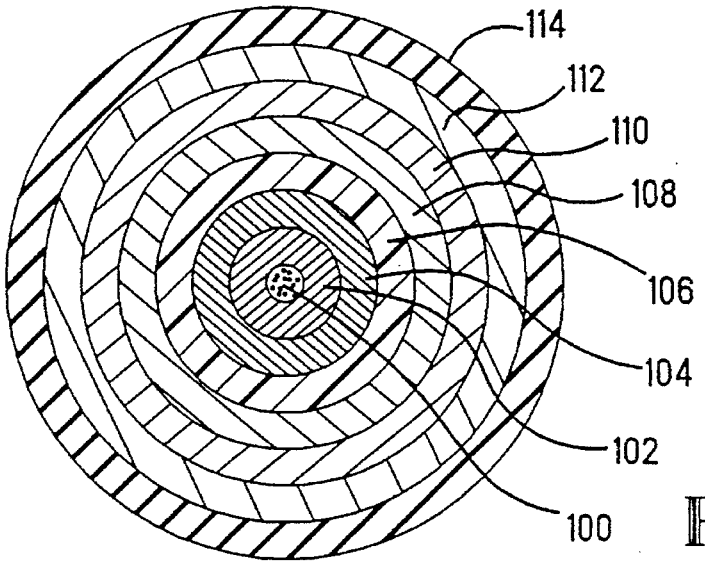
FIG. 10 illustrates an embodiment of a traffic sensor of the invention in which two piezoelectric sensors are concentrically disposed within the same cable.

As shown in FIG. 10 (not drawn to scale), such a concentric piezoelectric sensor in accordance with the invention preferably includes a center core 100, about which an inner piezoelectric polymer layer 102 (sensor A) is wrapped. An inner electrode 104 is then formed on the inner piezoelectric polymer layer 102, and a dielectric layer 106 is disposed about the inner electrode 104. A middle electrode 108 is then placed about the dielectric 106, and an outer piezoelectric polymer layer 110 (sensor B) disposed about the middle electrode 108. An outer electrode 112 is then formed about the outer piezoelectric polymer 110, and the entire structure is disposed within an outer jacket 114 for protection from the elements. Of course, one skilled in the art will appreciate that it is possible to increase the number of layers and piezoelectric sensors in the multi-layer piezoelectric cable of FIG. 10; however, the number of layers in the resulting multi-layer piezoelectric cable is limited by the number of channels of information that are actually needed.

Those skilled in the art will appreciate that the number of lanes of a roadway that can be monitored with a given number of sensors in accordance with the invention is limited by the number of "states" that are available for the piezoelectric sensors. As used herein, "states" refers to the polarization states of the piezoelectric sensor and may be positive (+), negative (–), or neutral (0). Of course, other types of polarization states may be used by those skilled in the art. The number of lanes L that can be monitored with a given number of parallel sensors n having a predetermined number of states s is $L=s^n$. However, as shown in FIG. 9, more lanes may be monitored by appropriately offsetting the piezoelectric sensors. In addition, one skilled in the art will appreciate that in the event that one state is neutral, only $L=s^n-1$ lanes may be monitored to take into account that the neutral state cannot by itself distinguish a lane.

Thus, piezoelectric sensors have been described which have different polarization states in different lanes when used in a traffic sensor. As noted above, one technique for manufacturing such piezoelectric sensors would be to splice lengths of positive and negative polarized material together. Although this would achieve the end result of having a cable or film with dual polarities, it introduces the weakness of the splices of the coaxial material. Accordingly, in accordance with another manufacturing technique, only the inner core of the piezoelectric material is spliced and then enclosed in a continuous braided sheath and outer jacket as shown in FIG. 2 in order to protect the piezoelectric material from the elements. This would produce a more robust package, although there would be the labor involved with doing the splices between the positively and negatively polarized material. Accordingly, the presently preferred technique for manufacturing the piezoelectric sensors of the invention would be to switch the polarity of the polarization voltage during the manufacturing process to conform the longitudinal sections of the piezoelectric material to the desired polarization. For example, 8 feet of material may be manufactured using a positive polarization voltage, while 4 feet would not be polarized, and the next 8 feet would be negatively polarized. The switching could be accomplished in any format desired to give the correct matrix of possibilities.

Those skilled in the art will recognize that the measured results may be confused if positive and negative pulses are generated by different sections of the same sensor at the same time. However, those skilled in the art also will appreciate that many different techniques may be used to solve this problem including, for example, doubling the intensity of the polarization in one direction. In addition, to lower the likelihood of such an occurrence, the pulse durations caused by deflection of the piezoelectric sensors may be minimized. Typical pulse durations are on the order of 4 msec, which gives a greater than 99% accuracy.

Figure 11:
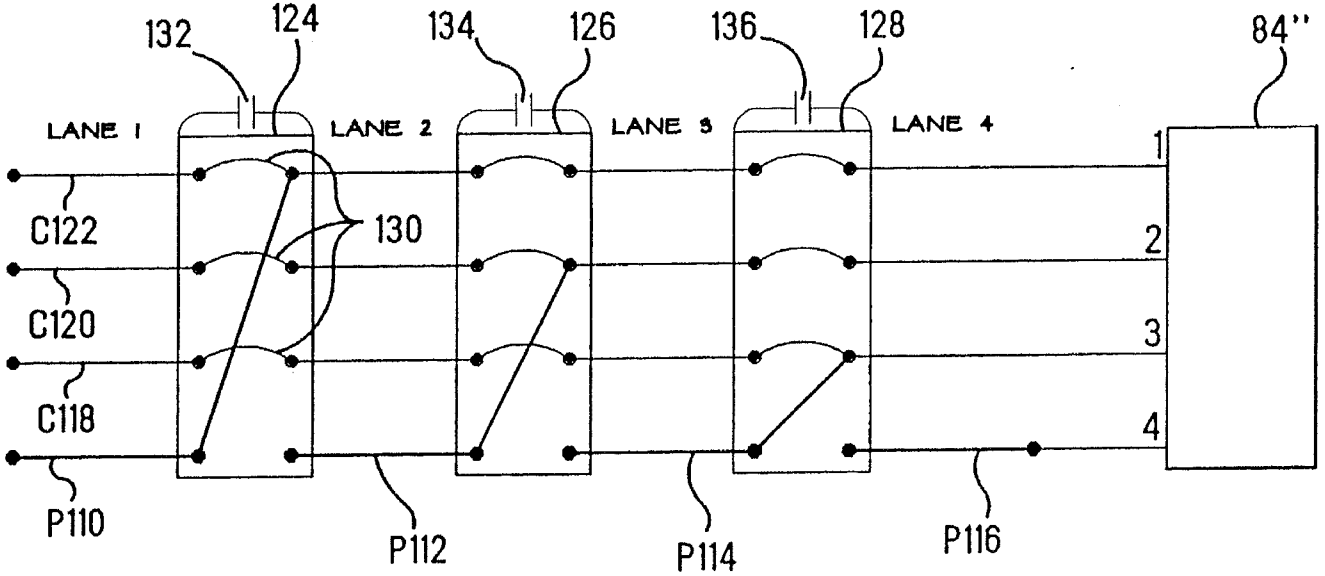
FIG. 11 illustrates an alternative embodiment of the invention in which a separate piezoelectric sensor is used for each lane of the roadway and is connected to a measuring device at the side of the roadway by separate coaxial cables disposed within the same rugged housing.

FIG. 11 illustrates an alternative embodiment of a traffic sensor in which separate piezoelectric sensors (P) 110–116 are disposed in each lane. The lanes are discriminated by connecting the piezoelectric sensor elements 110–116 to respective cables (C) 118–122 as illustrated so that a separate cable is provided for each lane and provided as an input to electronics 84. Separate switching boxes 124–128 are preferably provided between the respective piezoelectric sensors for appropriately connecting the piezoelectric sensors 110–116 to a unique cable C. Jumpers 130 may be used to connect the cables C through the switching boxes 124–128 to the electronics 84" as illustrated. Preferably, the capacitances of each of the respective cables 118–122 are balanced by disposing capacitors 132–136 across each of the switching boxes 124–128 as illustrated. Of course, one skilled in the art will appreciate that the piezoelectric sensors 110–116 may be offset from each other so that they are included along their own unique cable 118–122 for providing an input to electronics 84.

Figure 12:
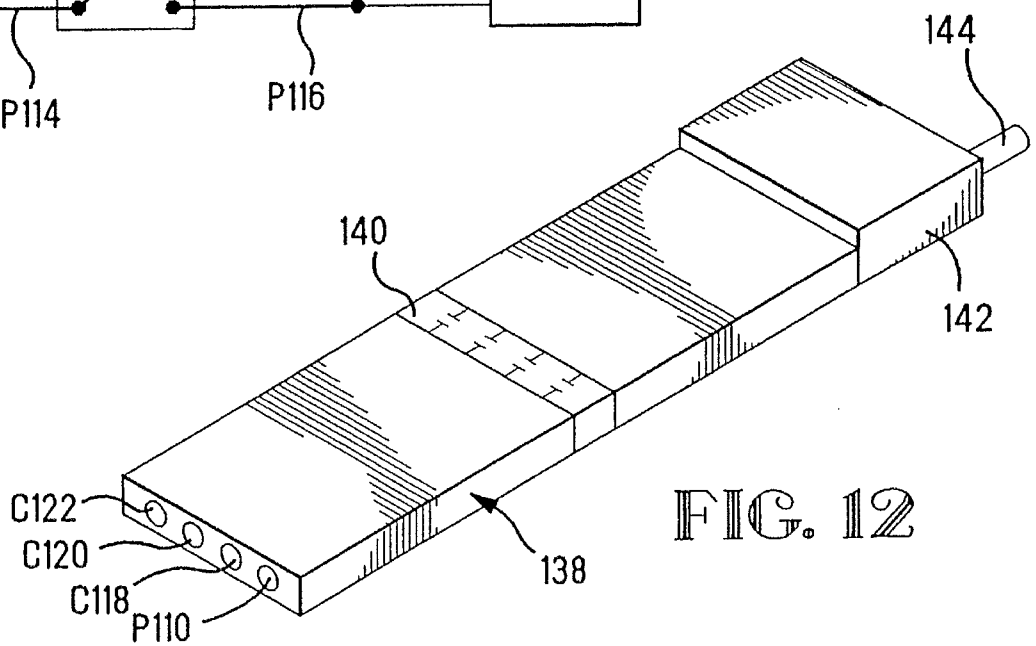
FIG. 12 illustrates the rugged housing of the embodiment of FIG. 11.

FIG. 12 illustrates the embodiment of FIG. 11 in its housing 138, which is preferably a durable material which is tapered at its edges so as to facilitate passage of a vehicle. As shown, the section including the switching boxes may be marked by a stripe 140 so that the piezoelectric sensors may be properly aligned on the roadway. The signals generated by the respective piezoelectric sensors are input via cables C into a junction box 142 which is typically at the side of the roadway. Junction box 142 may be connected via a cable 144 or a modem and the like to remote electronics. A similar housing may be used for each of the other embodiments described herein.

Figure 13:
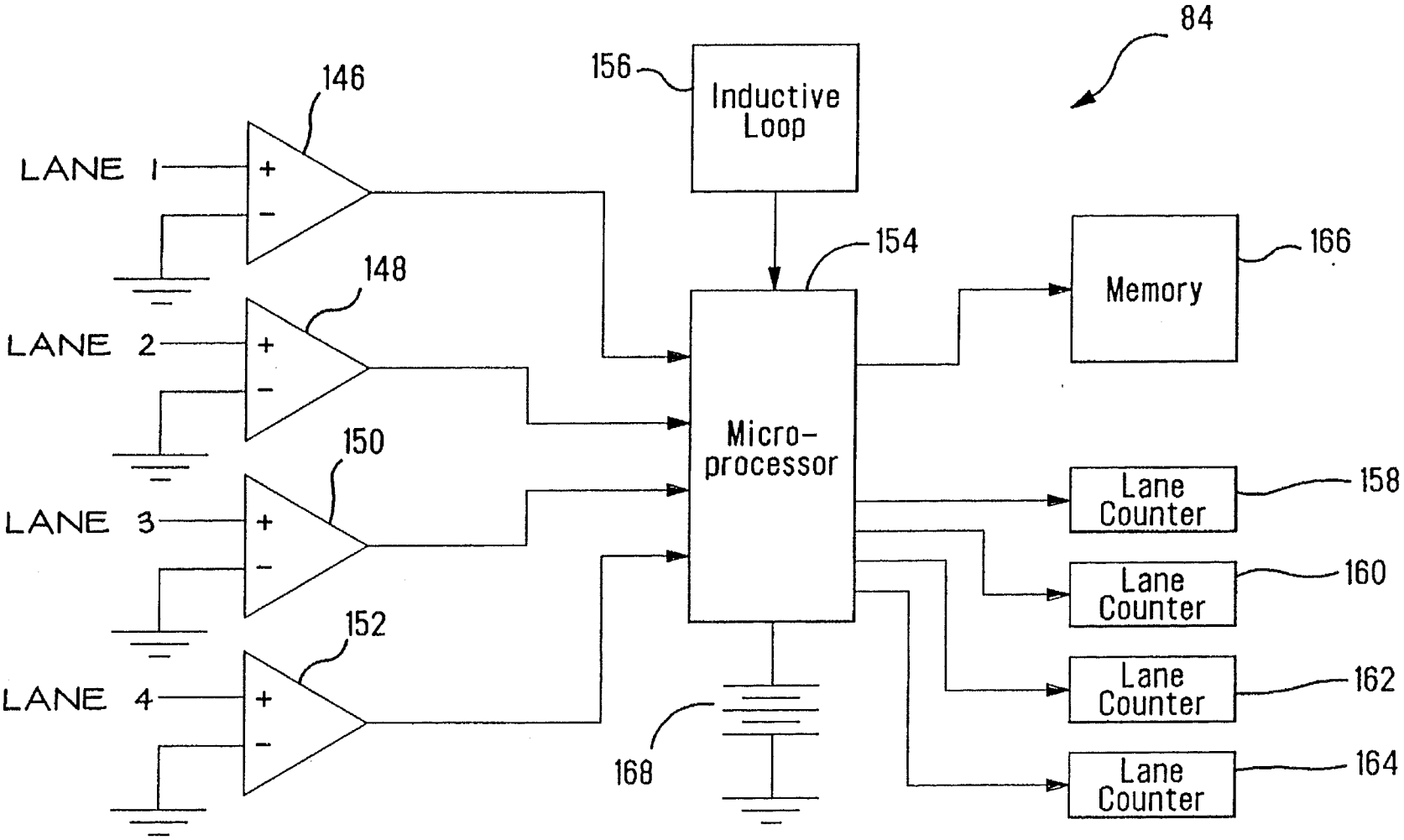
FIG. 13 illustrates a sample embodiment of the electronics used in accordance with the invention for discriminating lanes of the roadway and storing the measured traffic data in accordance with the lane from which it was received.

FIG. 13 illustrates a sample embodiment of electronics 84. As illustrated, electronics 84 may include a plurality of operational amplifiers 146–152 for discriminating the polarity of the received electrical signals from each input cable. The polarities of the received signals are typically determined by comparing the received electrical signal to a trigger level in accordance with techniques well known by those skilled in the art. The resulting signals are then input into microprocessor 154 and the like for determining which lane is addressed by the particular combination of positive and negative electrical signals. This may be accomplished using simple Boolean logic elements or a simple truth table and the like.

In a preferred embodiment, the traffic sensor of the invention further includes an inductive loop 156 of the type described, for example, by Gebert et al. in U.S. Pat. No. 5,008,666. As known by those skilled in the art, such an inductive loop 156 detects the passage of a vehicle for use in determining the number of electrical signals which were received during passage of the vehicle. In this manner, the number of axles corresponding to a particular vehicle may be determined to aid in vehicle classification.

Microprocessor 154 increments the appropriate lane counter 158–164 to indicate that a vehicle has passed through the lane identified by the received electrical signals. On the other hand, the received electrical signals may be time stamped by microprocessor 154 and the vehicle type determined so that lane data, vehicle type data, and time and date data may be stored in memory 166. Preferably, electronics 84 are battery powered by a battery 168 and the collected data retrieved on a regular basis based on the memory size of memory 166 and/or the charge duration of battery 168. At the end of some predetermined time such as a week or a month, traffic data from memory 166 is dumped and battery 168 recharged or replaced.

Although exemplary embodiments of the invention have been described in detail above, those skilled in the art will readily appreciate that many additional modifications are possible in the exemplary embodiments without materially departing from the novel teachings and advantages of the invention. For example, vehicle speed data may be calculated in accordance with the invention by placing two piezoelectric sensors at a known distance from each other and then calculating the time delay between deflections using techniques well known to those skilled in the art. In addition, differently polarized piezoelectric sensors may be placed across the roadway to provide lane segregation in a manner similar to that described by Myers. In particular, a first piezoelectric sensor with a first polarity would extend completely across two lanes of traffic while a second piezoelectric sensor with a second polarity would extend only across one lane. The lane through which a vehicle passes would then be discriminated from the polarities of the received signals rather than the logical ANDing of the positive outputs from each cable as described by Myers. Accordingly, all such modifications are intended to be included within the scope of this invention as defined in the following claims.

We claim:

1. A traffic sensor for sensing the number of vehicles travelling in each lane of a predetermined portion of a roadway, comprising:

a piezoelectric sensor stretched across a width of said predetermined portion of said roadway, said piezoelectric sensor generating an electrical signal when deflected by a vehicle, generated electrical signal having a first polarity when deflected by a vehicle in a first lane of said roadway and a second polarity when deflected by a vehicle in a second lane of said roadway; and means for discriminating the polarity of said generated electrical signal and for determining from the respective polarities in which lane of said roadway said piezoelectric sensor has been deflected by one of the vehicles.

2. The traffic sensor as in claim 1, wherein said discriminating and determining means comprises first and second counters corresponding to said first and second lanes of said roadway, said first counter being incremented when said electrical signal has said first polarity and said second counter being incremented when said electrical signal has said second polarity.

3. The traffic sensor as in claim 1, wherein said discriminating and determining means comprises a microprocessor for determining the time of arrival of a received electrical signal, and the polarity of a received electrical signal and a memory for storing data indicating said time of arrival along with a designation of a lane from which said electrical signal was generated.

4. The traffic sensor as in claim 3, further comprising an inductive loop for detecting the passage of a vehicle, said microprocessor being responsive to an output of said inductive loop and determining from said output the number of the electrical signals generated in a particular lane correspond to a single vehicle.

5. A traffic sensor for sensing the number of vehicles travelling in each lane of a predetermined portion of a roadway, comprising:

a first piezoelectric sensor stretched across a width of a lane of said predetermined portion of said roadway, said first piezoelectric sensor outputting an electrical signal having a first polarity when deflected by a vehicle in said lane;

a second piezoelectric sensor stretched across said width of said lane and another lane of said predetermined portion of said roadway, said second piezoelectric sensor outputting an electrical signal having a second polarity when deflected by a vehicle in either said lane or said another lane; and means responsive to said electrical signals from said first and second piezoelectric sensors for uniquely identifying from the polarities of said electrical signals whether a vehicle has passed through said lane or said another lane of said roadway.

6. A traffic sensor for sensing the number of vehicles traveling in each of L lanes of a predetermined portion of a roadway comprising:

n piezoelectric sensors stretched across a width of said predetermined portion of said roadway, each of said n piezoelectric sensors generating an electrical signal having one of s states of polarity when deflected by a vehicle in one of said L lanes of said roadway; at least one lane having a different polarity from an adjacent lane; and a lane identifier responsive to respective polarities of generated electrical signals from said n piezoelectric sensors for uniquely identifying one of $L=S^n$ said lanes from at least one other of said lanes of said roadway in which at least one of said n piezoelectric sensors was deflected by a sensed vehicle.

7. The traffic sensor as recited in claim 6, wherein said lane identifier comprises, respective counters for said lanes of said roadway, a counter corresponding to a particular lane being incremented when one of the electrical signals generated by at least one of said n piezoelectric sensors is received which has a state of polarity uniquely identifying said particular lane from at least one other lane.

8. The traffic sensor as in claim 6, wherein said lane identifier comprises a microprocessor for determining the time of arrival of received electrical signals, and the state of the polarity of received electrical signals and a memory for storing data indicating said time of arrival along with a designation of a lane from which respective said electrical signals were generated.

9. The traffic sensor as in claim 8, further comprising an inductive loop for detecting the passage of a vehicle in a lane of said roadway, said microprocessor being responsive to an output of said inductive loop and determining from said output the number of the electrical signals generated in a particular lane corresponds to a single vehicle.

10. The traffic sensor as in claim 6, wherein said n piezoelectric sensors are disposed substantially parallel to each other over said L lanes of said predetermined portion of said roadway.

11. The traffic sensor as in claim 10, wherein said n piezoelectric sensors are disposed concentrically with respect to each other over said L lanes of said predetermined portion of said roadway.

12. The traffic sensor as recited in claim 6, wherein said L lanes is defined by ($L=s^n-1$) when n includes a polarity of neutral.

13. The traffic sensor as recited in claim 12, wherein, said discriminator comprises, a microprocessor determining the time of arrival and polarity of a received electrical signal and a memory storing data indicating said time of arrival along with a designation of a lane from which said electrical signal was generated.

14. The traffic sensor as recited in claim 13, and further comprising: an inductive loop detecting a passage of a single vehicle, and said microprocessor being responsive to an output of said inductive loop and determining from said output the number of the electrical signals corresponds to said single vehicle.

15. A method of making a piezoelectric sensor having a first polarity for a first finite length in a first longitudinal section thereof and a second polarity, different from said first polarity, for a second finite length in a second longitudinal section which is adjacent said first longitudinal section in a longitudinal direction of said sensor, comprising the steps of:

extruding a piezoelectric material through an extruder at a predetermined rate;

applying an electric field having said first polarity to said piezoelectric material for a first predetermined amount of time in accordance with said predetermined rate until said first finite length is polarized with said first polarity;

switching said electric field to said second polarity; and applying said electric field having said second polarity to said piezoelectric material for a second predetermined amount of time in accordance with said predetermined rate until said second finite length is polarized with said second polarity.

16. A traffic data acquisition method, comprising the steps of:

laying n piezoelectric sensors across L lanes of a predetermined portion of a roadway;

generating an electrical signal by each of said n piezoelectric sensors, said signals vehicle in one of said lanes L of said roadway at least one lane having a different polarity from an adjacent lane; and determining from said electrical signals from said n piezoelectric sensors which one of $L=s^n$ said lanes of said roadway and at least one of said n piezoelectric sensors deflected by a vehicle.

17. The method as in claim 16, wherein said laying step comprises the further step of disposing said n piezoelectric sensors across said L lanes of said predetermined portion of said roadway such that the states of the polarity of the electrical signals generated in a particular lane for the respective piezoelectric sensors in said particular lane uniquely identify each of said $L=s^n$ lanes of said roadway.

18. The method as in claim 17, comprising the further steps of time stamping received electrical signals and storing time of receipt data with lane data identifying the lane from which said electrical signals were received.

19. A traffic sensor for sensing the number of vehicles travelling in each lane of a predetermined portion of a roadway, comprising: at least one piezoelectric sensor stretched across a width of said predetermined portion of said roadway, said piezoelectric sensor generating at least one electrical signal when deflected by a vehicle, each said electrical signal having a first polarity when deflected by a vehicle in a first lane of said roadway and a second polarity when deflected by another vehicle in another lane of said roadway, and a discriminator for determining the polarity of each said electrical signal that corresponds to the lane in which the piezoelectric sensor was deflected by each of the vehicles.

20. The traffic sensor as recited in claim 19, wherein, said discriminator comprises, first and second counters corresponding to said first and second lanes of said roadway, said first counter being incremented when said electrical signal has said first polarity, and said second counter being incremented when said electrical signal has said second polarity.

21. A traffic sensor for sensing vehicles traveling in different lanes of a roadway, comprising: piezoelectric sensors placed in the different lanes, a first piezoelectric sensor and a second piezoelectric sensor have polarities along their respective longitudinal sections corresponding to each lane so that a unique combination of electrical signals will be received, wherein said first piezoelectric sensor placed in a first land with a first polarity, said second piezoelectric sensor placed in an adjacent lane with a different polarity, and each piezoelectric sensor generating at least one electrical signal having one of said combinations of polarities when said each piezoelectric sensor is deflected by a vehicle in one of the different lanes, and a discriminator discriminating the combination of polarities of each said electrical signal to determine the corresponding lane in which said piezoelectric sensor was deflected by said vehicle.

22. The traffic sensor as recited in claim 21, wherein, said first piezoelectric sensor comprises piezoelectric material having a first combination of solely positive polarity adapted to be in a first of said lanes, and said second piezoelectric sensor comprises a second solely negative polarity adapted to be in a second of the lanes, and the discriminator comprises a bipolar discriminator.

23. The traffic sensor as recited in claim 21, wherein, said each piezoelectric sensor comprises at least two strips of piezoelectric material parallel with one another, and a series of multiple said parallel strips having respective polarities, the multiple said parallel strips being adapted to be in respective lanes of the roadway, and the electrical signal having a combination of said respective polarities unique to the corresponding one of the lanes in which said strips were deflected by said vehicle.

24. The traffic sensor as recited in claim 23, wherein, said strips are concentric.

25. The traffic sensor as recited in claim 21, and further comprising: a lane identifier responsive to said combinations and uniquely identifying one of said lanes from at least one other of said lanes.

26. The traffic sensor as recited in claim 25, wherein, said identifier comprises, a counter for each of said combinations, said counters being incremented individually by respective signals having said combinations.

27. The traffic sensor as recited in claim 26, wherein, said identifier comprises, an inductive loop detecting passage of a single vehicle, and a microprocessor responsive to an output of the inductive loop and the counter, and determining the number of electrical signals received during passage of said single vehicle.

28. The traffic sensor as recited in claim 25, wherein, said identifier comprises, a microprocessor determining the time of arrival and the combination of a received electrical signal, and a memory storing data indicating said time of arrival and a designation of a lane from which said electrical signal was generated.

* * * * *